US005513687A

United States Patent [19]

Tuzmen et al.

[11] Patent Number: 5,513,687

[45] Date of Patent: May 7, 1996

[54] SAFETY DEVICE FOR PULL CORDS OF WINDOW COVERINGS

[75] Inventors: Zeki Tuzmen, Irvine; Julius F. John, Redondo Beach, both of Calif.

[73] Assignee: Newell Operating Company, Freeport, Ill.

[21] Appl. No.: 287,205

[22] Filed: Aug. 8, 1994

[51] Int. Cl.[6] ..... E06B 9/30

[52] U.S. Cl. ..... 160/168.1; 160/178.1

[58] Field of Search ..... 160/168.1 R, 168.1 V, 160/177 V, 177 R, 176.1 R, 176.1 V, 178.1 R, 178.1 V, 178.2 R; 16/216, 217, 219, 122; 254/385, 386; 74/502

[56] References Cited

U.S. PATENT DOCUMENTS

| | | | |
|---|---|---|---|
| 2,116,357 | 5/1938 | Laborda et al. | 160/168.1 R |
| 2,410,549 | 11/1946 | Olson | 160/173 R X |
| 5,038,843 | 8/1991 | Sommerfeld | 160/168.1 VX |

*Primary Examiner*—Blair M. Johnson
*Attorney, Agent, or Firm*—Foley & Lardner

[57] ABSTRACT

A safety device (10) for use with vertically projecting pull cords (13, 14, 15, 16) for a window covering is disclosed. The device (10) is interconnected to a headrail assembly (11) and has a plurality of telescoping sections (30, 40, 50) with differing diameters (D30, D40, D50) that house the cords (13, 14, 15, 16) and is movable between a first retracted position and a second extended position with means (60, 19) (160, 170) for receiving and retaining the pull cord.

8 Claims, 4 Drawing Sheets

SAFETY DEVICE FOR PULL CORDS OF WINDOW COVERINGS

DESCRIPTION

1. Technical Field

The present invention relates generally to pull cords for window coverings, more particularly, to a safety device for housing the pull cords to protect children from injury when they come in contact with such cords.

BACKGROUND OF THE INVENTION

Most window coverings, such as horizontal blinds, have pull cords to adjust the height of the window covering. The blind comprises a plurality of equally spaced, parallel, horizontal slats or louvers. The pull cords generally extend downwardly from a headrail assembly positioned within or behind a valance assembly adjacent the top of the window being covered. In traditional configurations, the cord assembly which raises and lowers the bottommost slat or sill rail of the window covering is a closed-loop. The closed-loop has two cords extending downwardly from the headrail which meet to form a U-shape or loop. One of the downwardly extending cords adjusts the horizontal positioning of the bottommost slat or sill rail of the window covering, while the other cord adjusts the other end of the same slat or sill rail. To maintain the window covering in a horizontal position, or level, while at the same time adjusting the height of the bottommost slat or sill rail, both cords must be pulled simultaneously with equal force.

Unfortunately, pull cords present dangers for small children. Small children have been known to play with the pull cords by pulling on the cords or putting the cords in their mouths. Very small children often play with the pull cords because their cribs may be placed next to a window covering with such cords. When children play with the pull cords, their heads may become entangled in the cords or they playfully place their heads through the pull cords. As a result, children have been injured by the pull cords; they have fallen out of their cribs while being held above the floor by the closed-loop pull cords.

One way to prevent the danger is to eliminate the closed-loop pull cord. However, closed-loop pull cords are desirable as they easily adjust the height of the window covering while maintaining the window covering in a horizontal position. To solve this problem, releasably interconnected fasteners, or safety tassels, have been developed. The fasteners attach to the end of each pull cord and establish a closed-loop between the pull cords, allowing the cords to separate if a sufficient force, such as the weight of a child, is applied to the fastener.

SUMMARY OF THE INVENTION

The present invention relates to a safety device for housing pull cords. According to a first aspect of the invention, the safety device is used with at least two vertically projecting pull cords from a headrail assembly for window coverings and the like, alleviating the noted safety concerns. The device includes a housing or sleeve containing two or more sections and movable between a first retracted position and a second extended position. One of the sections, the one positioned farthest from the headrail, includes means for receiving and retaining the pull cords. Another section, the one closest to the headrail, employs means for interconnecting the housing to the headrail. The sections of the housing act in a telescoping manner with respect to one another. As a result, the entire system permits the pulling, retracting and releasably holding of the pull cords and the housing simultaneously to any one of a plurality of positions between the retracted position and the extended position.

According to another aspect of the present invention, the housing includes at least two tubular sections, one section nestling within and movable relative to the other section. Specifically, the sections are cylindrical and have different diameters and means therein to frictionally engage each other. In another embodiment the friction between the components is minimized permitting free sliding due to gravity between the components.

According to yet another aspect of the present invention, the means for receiving and retaining the pull cords is an aperture positioned in the farthest section from the headrail, and a stop, larger than the aperture and connected to the pull cords, whereby when the pull cords are threaded through the aperture from one side and the stop is positioned on the other side of the aperture, the stop prevents the pull cords from passing through the aperture when a pulling force is exerted on the cords in a direction away from one side of the aperture and away from the headrail. The aperture may also be formed in an internal transverse flange or top of a cap interconnected to the farthest end of the farthest section from the headrail.

In another embodiment, the means for receiving and retaining the pull cord is a freely rotatable pulley disposed in the farthest section, the pulley being adapted for receiving the pull cords and the pull cords being anchored at both ends either to the headrail, to the means for interconnecting the housing to the headrail, or to the section closest to the headrail. In short, the cord is wrapped around the pulley that is positioned between both the ends. The pulley is fixedly attached to a cap interconnected to the far end of the farthest section from the headrail. There is also a freely rotatable pulley disposed in the other section(s), adapted for receiving and guiding the pull cords.

Other advantages and aspects of the present invention will become apparent upon reading the following description of the drawings and detailed description of the invention.

BRIEF DESCRIPTION OF THE DRAWINGS

In order that the present invention may be more fully understood, it will now be described by way of example, with reference to the accompanying drawings in which.

DETAILED DESCRIPTION OF THE PREFERRED EMBODIMENT

Figure 1:
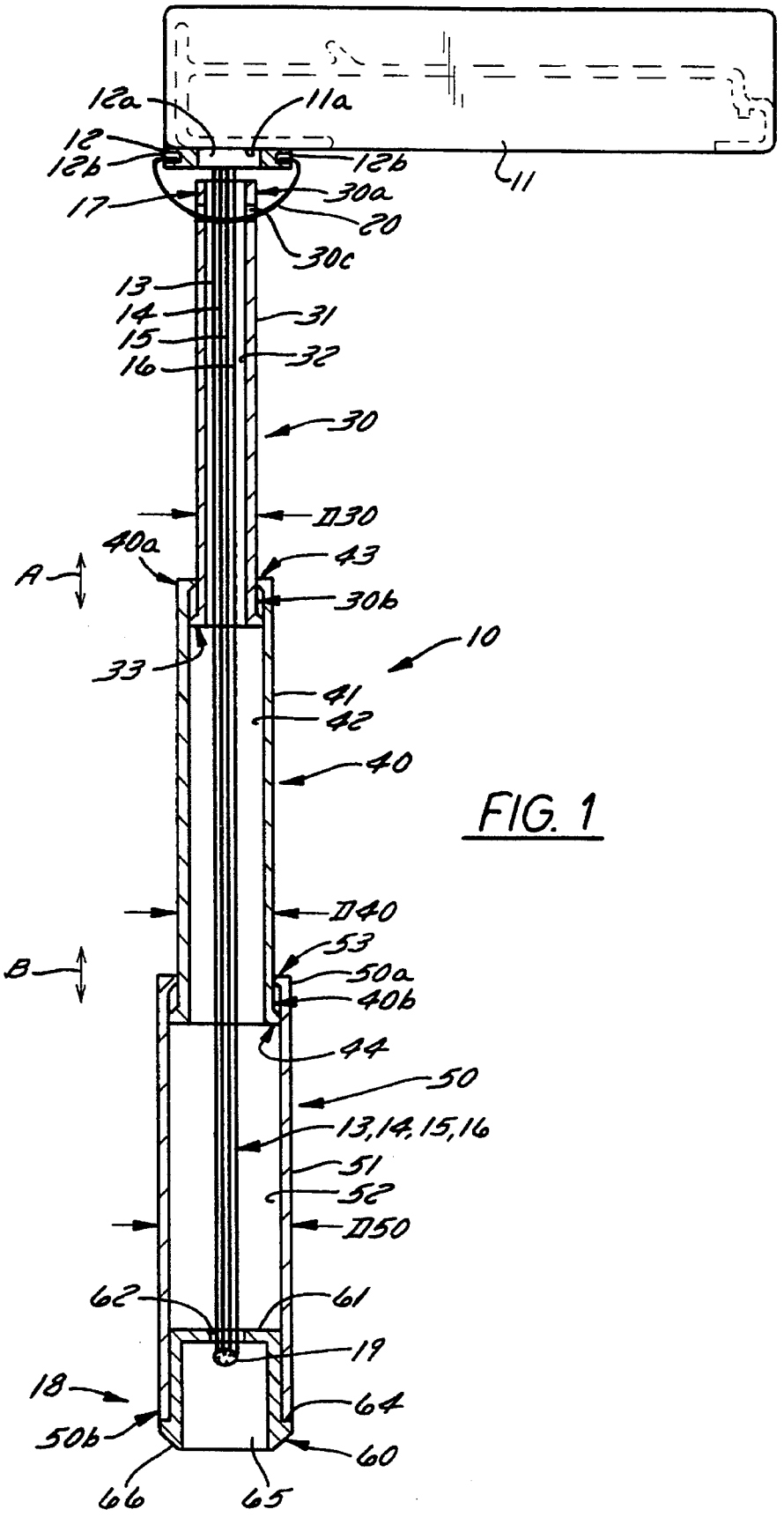
FIG. 1 is a side sectional view of a first embodiment of the safety device made in accordance with the teaching of the present invention.

While the invention is susceptible of embodiment in many different forms, there is shown in the drawings and will herein be described in detail, some preferred embodiments of the invention with the understanding that the present disclosure is to be considered as an exemplification of the principles of the invention and is not intended to limit the broad aspect of the invention to the embodiments illustrated.

Referring to the drawings, FIG. 1 shows the safety device of the present invention, generally designated by the reference number 10. While shown in sectional, the device is tubular or cylindrical. The safety device 10 is used with at least two vertically projecting pull cords 13, 14, generally used with window coverings (not shown) and the like. Additional pull cords 15, 16 may also be used. The pull cords 13, 14, 15, 16 feed through an opening 11*a* in the headrail 11 mounted to the wall or window cavity above the window to be covered, and housing mechanical devices for the window covering.

A mounting piece 12 is made part of the headrail or mechanically attached to the headrail by an adhesive or fastener. The mounting piece 12 has a central opening 12*a* corresponding to and disposed adjacent to the opening 11*a* in the headrail 11. The mounting piece also has two opposed side holes 12*b* for receiving the cooperating mounting means of the safety device.

Figure 5:
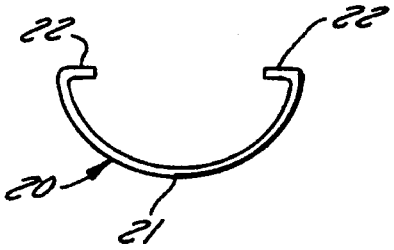
FIG. 5 is a detail of the mounting clip.

In particular, the safety device 10 is connected to the mounting piece 12 by a C-clip 20. The C-clip, shown in the detail of FIG. 5, includes an arcuate portion 21 and two inwardly projecting portions 22. The C-clip may be made of a bent metal rod. Each of the two inwardly projecting portions 22 fit within one of the two opposed holes 12*b* in the mounting piece 12. The C-clip is also threaded through the device 10; the clip may also be fastened to the device. In addition to this configuration, an end cap with a connector thereon may be attached to the upper end 17 of the device 10 to cooperate with the mounting piece 12.

As shown in FIGS. 1–3, 4 and 6, the device 10 includes a housing or sleeve having three cylindrical, hollow sections 30, 40, 50 of varying diameter. Each tubular section 30, 40, 50 has an outer casing 31, 41, 51, an inner longitudinal channel 32, 42, 52 and opposed ends 30*a*, 30*b*, 40*a*, 40*b*, 50*a*, 50*b*. The first section 30 has a diameter D30 smaller than the diameter D40 of the second section 40 permitting the first section to slide within the second section (Arrow A). Similarly, the second section 40 has a diameter D40 smaller than the diameter D50 of the third section 50 permitting the second section to slide within the third (Arrow B). As a result of the sizing, the first section 30 nestles within the second section 40 and the second section nestles within the third section 50. The entire sleeve 10 operates in a telescoping manner and is movable between a first retracted position and a second extended position. The Figures show the device just prior to reaching its full extended position.

Figure 2:
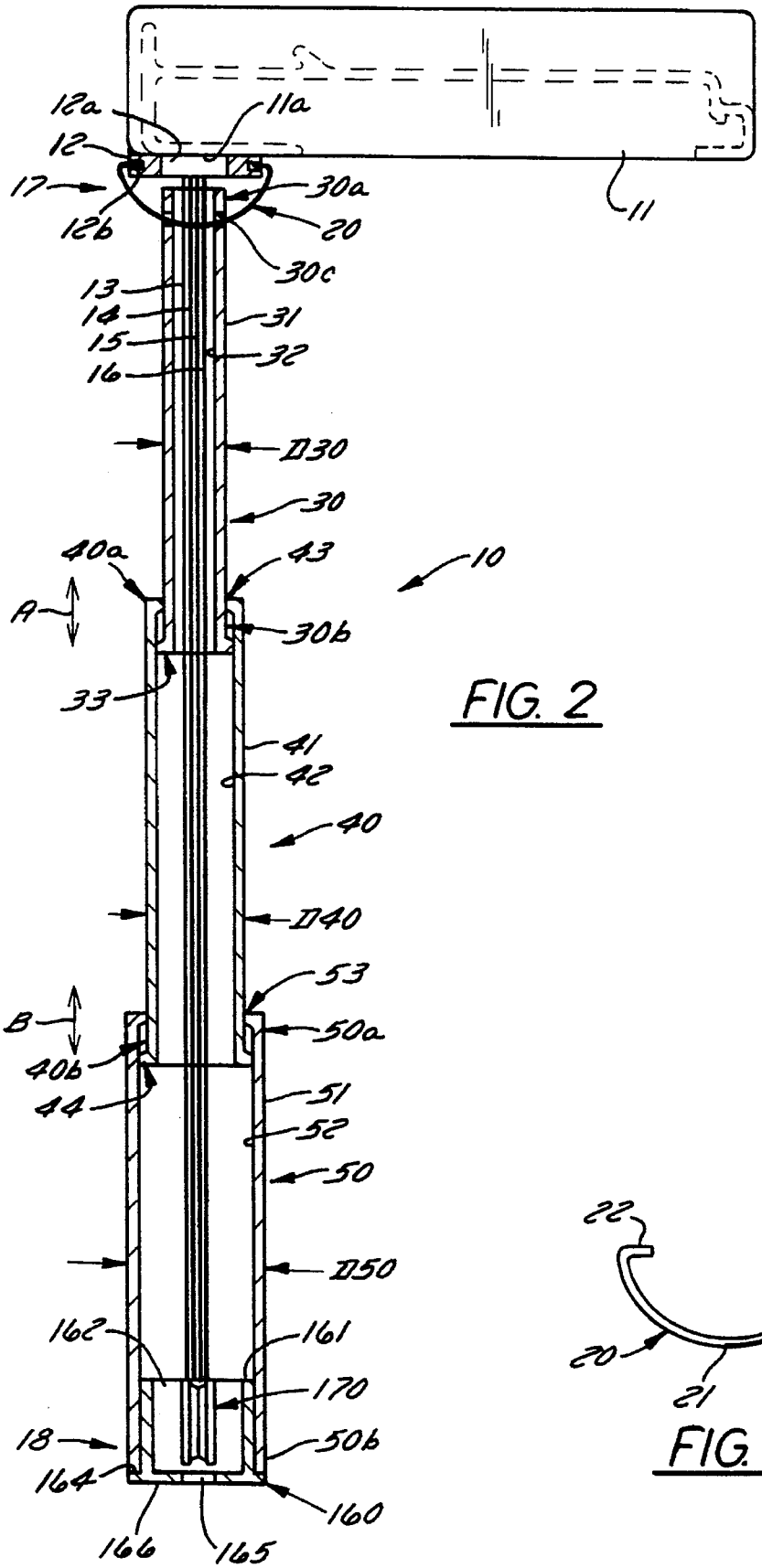
FIG. 2 is a side sectional view of a second embodiment of the safety device.

The first section 30 has one end 30*a* positioned close (17) to the headrail 11 and the third section 50 has one end 50*b* (the far end or distal end) disposed farthest (18) from the headrail. Opposed openings 30*c* are drilled adjacent the end 30*a* of the first section 30 closest to the headrail to receive the threaded C-clip 20. As shown in FIGS. 1 and 2, once assembled, the arcuate portion 21 of the C-clip 20 rests in the openings 30*c* of the first section 30.

A projecting radial end flange is built into or connected to the end of each section that cooperates with another section. In particular, the near end 40*a* (the end nearest the headrail) of the second section 40 has an inwardly projecting radial end flange 43 for contacting and cooperating with the outer surface of the first section 30. The other end, or far end 40*b* (the end farthest from the headrail) of the second section 40 has an outwardly projecting radial end flange 44 for contacting and cooperating with the inner, channel surface of the third section 50. Similarly, the third section 50 has an inwardly projecting radial near end flange 53 for contacting and cooperating with the outer surface of the second section 40. And, the far end 30*b* of the first section 30, the one opposite the near end 30*a* adjacent the headrail 11, has an outwardly projecting radial end flange 33 for contacting and cooperating with the inner, channel surface of the second section 40.

The slight clearance between the inner surfaces of the sections and the distal ends of the outwardly projecting end flanges 33, 44 of the adjacent section and between the outer surface of the sections and the distal ends of the inwardly projecting end flanges 43, 53 may provide a constant friction between the components permitting a frictional engagement between the three sections 30, 40, 50 at any point they contact one another. Thus, one sliding the third section relative to the second section, or the second section relative to the first section, will feel a slight resistant force present due to friction. When any sections are in a desired position, the user may release one section and the frictional forces between the sections, specifically the flange of one section and the inner or outer surface of the other section, will maintain the sections in their respective positions.

With this construction, the first section remains stationary and attached to the headrail and the sleeve may be moved between its compressed or retracted position, when the first section is completely nestled in the second section and the second section is completely nestled in the third section, and its completely extended position, when the sections are no longer nestled, by pulling or pushing the far end (18, 50*b*) of the sleeve.

Figure 7:
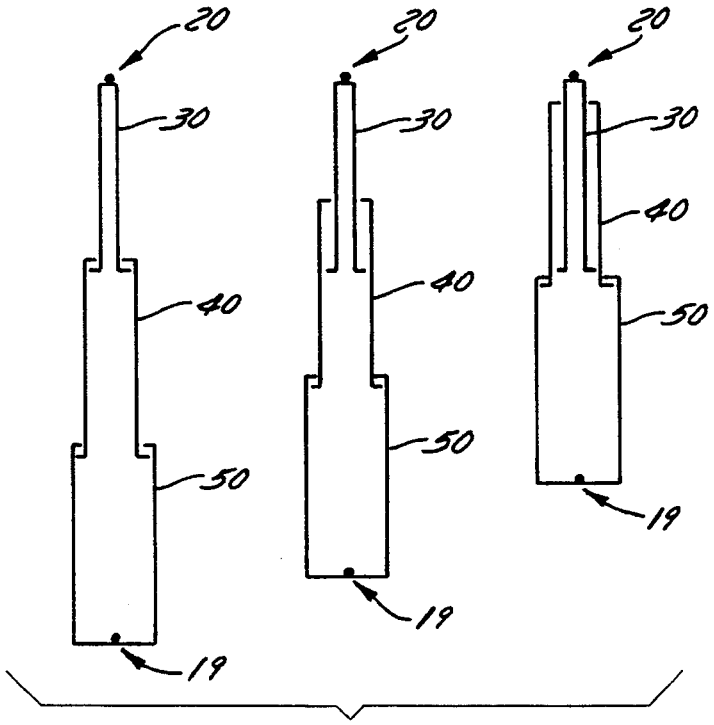

In the alternative, the clearance between components may be greater, permitting free movement between the parts. Friction between the walls and the flanges may be kept at a minimum. Consequently, the device 10 will hang from the clip 20 and the tubular sections 30, 40, 50 will position themselves by gravity. The stop or knot (19-first embodiment) or the pulley (170-second embodiment) determine the position of the third section 50. In short, the first section's position is stationary and the position of the third section is determined by the stop or pulley (discussed below). The second section will then adjust by gravity its relative position to the third and first section. This is shown in the schematic diagram of FIG. 7 showing three different positions of the stop 19.

Figure 4:
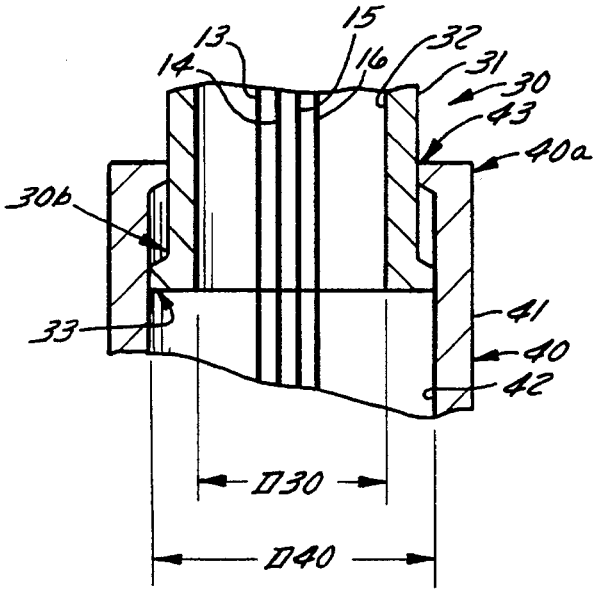
FIG. 4 is a detail, sectional view of two sections and the cooperation therebetween.

The radial flanges further prevent adjacent sections from totally separating. For example, the first and second sections 30, 40 are prevented from separating because the radially outward projecting end flange 33 of the first section, which has a smaller diameter D30 than that D40 of the second section, and the radially inward projecting end flange 43 of the second section act as a stop or bumper to one another preventing further longitudinal movement of the sections away from one another. This is shown in the detail of FIG. 4. The second and third sections 40, 50 are prevented from separating because the radially outward projecting end flange 44 of the second section, which has a smaller diameter D40 than that D50 of the third section, and the radially inward projecting end flange 53 of the third section act as a stop or bumper to one another preventing further longitudinal movement of the sections away from one another.

Figure 6:
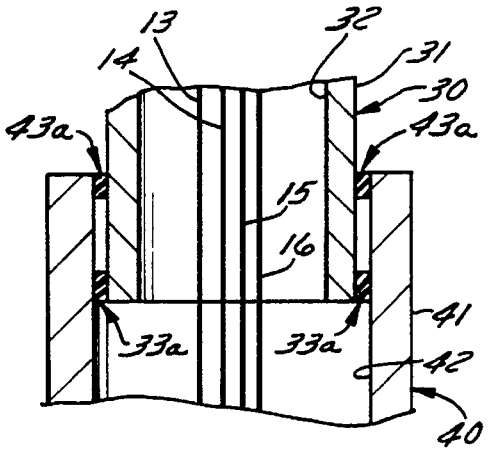
FIG. 6 is a detail, sectional view of two sections, each with O-rings thereon, and the cooperation therebetween; and, FIG. 7 is a schematic view of the three sections in three orientations without friction therebetween.

As shown in FIG. 6, the end flanges need not be integral with the section pieces. Each flange may be replaced, for example, by an O-ring. Thus, the inward end flange 43 of the second section 40 may be replaced by an O-ring 43*a* secured, such as by an adhesive, to this section. FIG. 6 also shows an O-ring 33*a* secured to the outer surface of the first section 30.

As noted previously, the housing or sleeve 10 further includes means for receiving and retaining the pull cords 13, 14, 15, 16. In both embodiments shown, the retaining means is in the form of a cap. In the first embodiment (FIG. 1), a cap 60 is connected to the far end or distal end 18 of the sleeve 10 (the far end 50*b* of the third section 50). The cap 60 has a top 61 (inwardly projecting flange) with an aperture 62 therein for receiving the pull cords 13, 14, 15, 16. The pull cords 13, 14, 15, 16 which fit through the aperture 62 are threaded through the aperture from one side and a stop, in the form of a knot 19 formed at the ends of the pull cords, is positioned on the other side of the aperture. The stop 19, larger in size than the aperture, prevents the pull cords 13, 14, 15, 16 from passing through the aperture 62 in the top 61 of the cap 60 when a pulling force is put onto the cord in a direction away from the threaded (headrail) side of the aperture. It is understood that while the cap is shown to have one aperture therein, it can have more, that being one aperture per pull cord. In addition, the stop may be any large object that fits inside the cap, is larger than the hole, and can be connected to the end of the cords. A piece of leather or a rod are two such devices.

As shown in FIG. 1, the cylindrical cap 60 fits snugly within the channel 52 of the third section 50 and has a ledge 64 for preventing the cap from being pushed completely into the end 50*b* of the section. The cap further has a large opening 65 in its bottom 66 for permitting one access to the pull cords 13, 14, 15, 16 and the stop 19. In addition, a plug may be inserted into the opening 65 to cover it up. This configuration is generally appropriate when the pull cords are between three and five feet in length.

While not shown, it should be understood that an aperture may be formed directly into the walls 51 of the third section, like the aperture in the cap, for receiving the pull cords. A stop would thus be connected to the cords outside the section and aperture.

With this design, one is free to pull, retract and release the pull cords and the housing simultaneously to any one of a plurality of positions between the retracted position and the extended position by merely gripping and maneuvering the end of the third section near the cap. Like other conventional pull cords for window coverings, the pull cords will lock due to a clutch mechanism in the headrail when they are oriented vertical to the headrail and will be free to move up or down when they are acutely angled to the headrail. The same is true with the safety device of the present invention. Because of the C-clip, the sleeve is free to pivot relative to the headrail permitting the sleeve with the cords therein to lock or move.

Figure 3:
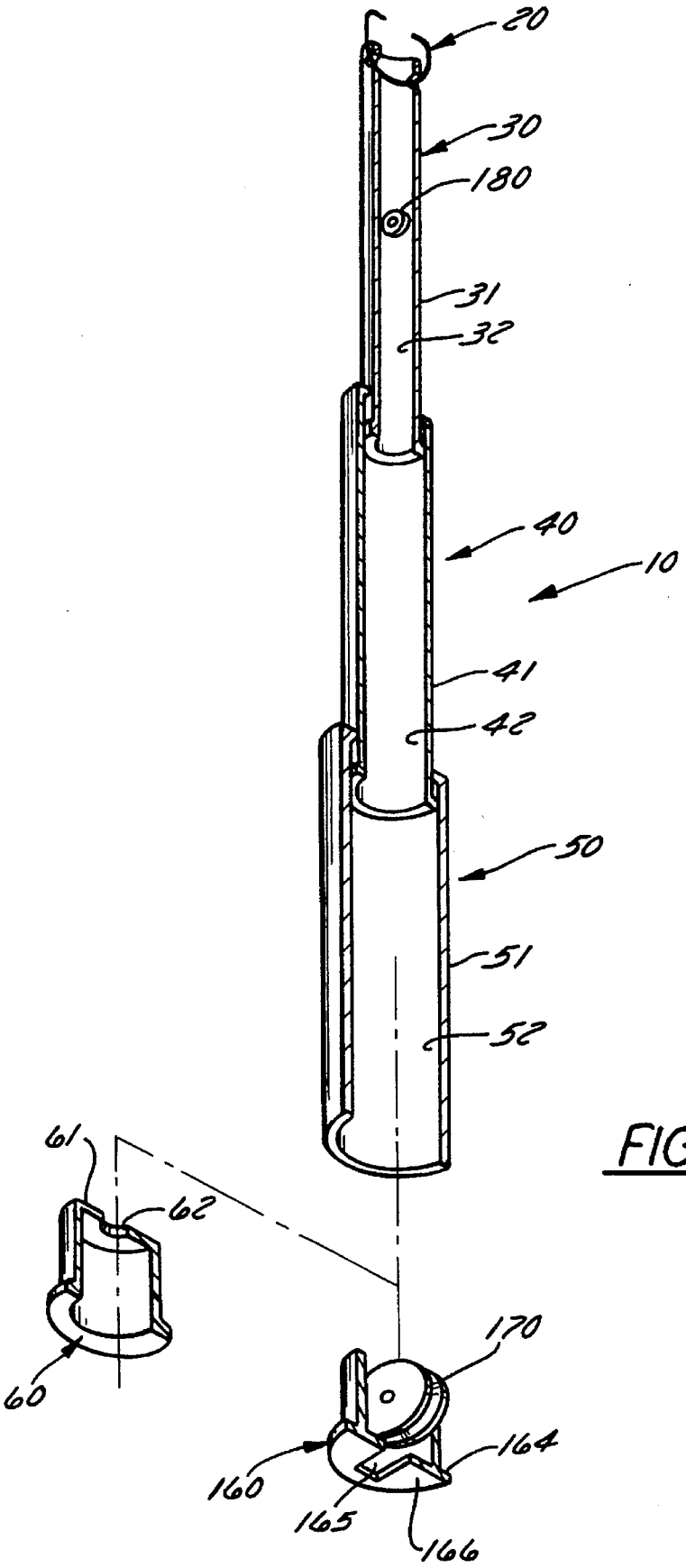
FIG. 3 is an exploded, side perspective sectional view of the second embodiment shown in FIG. 2.

In the second embodiment of FIGS. 2 and 3, a cap 160 is connected to the far or distal end 18 of the sleeve 10 (the far end 50*b* of the third section 50). The cap 160 has a top 161 (inwardly projecting flange) with an aperture 162 therein for receiving the pull cords 13, 14, 15, 16. The pull cords 13, 14, 15, 16 which fit through the aperture 162 are threaded through the aperture from one side, around a freely rotatable pulley 170, the pulley being secured within the cap, out the aperture 162 and back to either the headrail 11, the clip 20 or the first section 30 where they are secured (not shown). In short, the ends of the pull cords are anchored to a stationary object.

As shown in FIGS. 2 and 3, the cylindrical cap 160 also fits snugly within the third section 50 and has a ledge 164 for preventing the cap from being pushed completely into the far end 50*b* of the section. The cap 160 further has a large opening 165 in its bottom 166 for access to the pull cords 13, 14, 15, 16 and the pulley 170. This configuration is generally appropriate when the pull cords are greater than five feet in length.

With this design, one is again free to pull, retract and release the pull cords and the housing simultaneously to any one of a plurality of positions between the retracted position and the extended position by merely gripping and maneuvering the end of the third section near the cap. The pull cords and housing will lock due to a clutch mechanism in the headrail when they are oriented vertical to the headrail and will be free to move when they are acutely angled to the headrail.

In this second embodiment, there is also a freely rotatable second pulley 180 (FIG. 2) disposed in the first section 30 adapted for receiving the pull cords and preventing tangling of the cords 13, 14, 15, 16. The housing may further have a conventional winder therein to reel in excess cord and keep the cords taut in the housing.

Finally, while three sections have been shown and described, it is understood that any number of sections may be used depending on, among other things, the length of the cords, the material and construction of the sections and the size of window covering.

With these designs, the housing protects and covers the pull cords. Consequently, children and animals cannot get entangled in and injured by the cords.

While the invention has been described with reference to some preferred embodiments of the invention, it will be understood by those skilled in the art that various modifications may be made and equivalents may be substituted for elements thereof without departing from the broader aspects of the invention. The present examples and embodiments, therefore, are illustrative and should not be limited to such details.

We claim:

1. A safety device used in conjunction with at least one pull cord projecting vertically from a headrail for window coverings and the like comprising:

a housing movable between a first retracted position and a second extended position with means for receiving and retaining the pull cord, wherein the housing includes at least two tubular sections, one section nestling within and movable relative to the other section, wherein the sections are cylindrical and have different diameters and means therein to frictionally engage each other, a means for interconnecting the housing to the headrail; wherein one section cooperates with the means for interconnecting the housing to the headrail and is disposed adjacent the headrail and wherein the means for receiving and retaining the pull cord is a freely rotatable pulley disposed in the other section adapted for receiving the pull cord, the pull cord being anchored at both ends to either the headrail, the means for interconnecting the housing to the headrail, or the one section, and wrapped around the pulley positioned between both the ends;

a means for pulling, retracting and releasably holding the pull cord and the housing simultaneously to any one of a plurality of positions between the retracted position and the extended position.

2. The safety device of claim 1 wherein each section has two ends and the pulley in the other section is fixedly attached to a cap interconnected to the end of the other section opposite the end closest to the one section.

3. The safety device of claim 2 wherein there is also a freely rotatable pulley disposed in the one section adapted for receiving the pull cord.

4. A safety device used in conjunction with at least two pull cords projecting vertically from a headrail for window coverings and the like comprising:

a sleeve having at least two sections, each having an internal channel and different diameters adapted for permitting movement relative to one another between a first retracted position and a second extended position with means for receiving and retaining the pull cord;

a means for interconnecting one section of the sleeve to the headrail;

a means for pulling, retracting and releasably holding the pull cords and the other section of the sleeve simultaneously to any one of a plurality of positions between the retracted position and the extended position; and, a means for preventing the two sections from totally separating.

5. The safety device of claim 4 wherein the means for preventing the two sections from totally separating is a radially outward projecting end flange on the section having a smaller diameter and a radially inward projecting end flange on the section having a larger diameter, the smaller diameter section nestling inside the outer diameter section and the two radially projecting flanges acting as stops to one another.

6. The safety device of claim 4 wherein one section cooperates with the means for interconnecting the sleeve to the headrail and is disposed adjacent the headrail and wherein the means for receiving and retaining the pull cord is a freely rotatable pulley disposed in the other section adapted for receiving the pull cord, the pull cord being anchored at both ends to either the headrail, the means for interconnecting the sleeve to the headrail, or the one section, and wrapped around the pulley positioned between both the ends.

7. The safety device of claim 6 wherein each section has two ends and the pulley in the other section is fixedly attached to a cap interconnected to the end of the other section opposite the end closest to the one section.

8. The safety device of claim 7 wherein there is also a freely rotatable pulley disposed in the one section adapted for receiving the pull cord.

* * * * *